US010822065B2

(12) United States Patent
Daley et al.

(10) Patent No.: US 10,822,065 B2
(45) Date of Patent: Nov. 3, 2020

(54) SYSTEMS AND METHOD FOR BUOYANCY CONTROL OF REMOTELY OPERATED UNDERWATER VEHICLE AND PAYLOAD

(71) Applicant: Cameron International Corporation, Houston, TX (US)

(72) Inventors: Harold Daley, Houston, TX (US); Mac M Kennedy, Houston, TX (US); Michael Urdiales, Montgomery, TX (US); Gerrit Kroesen, Friendswood, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/662,529

(22) Filed: Jul. 28, 2017

(65) Prior Publication Data

US 2019/0031308 A1 Jan. 31, 2019

(51) Int. Cl.
*B63G 8/00* (2006.01)
*B63G 8/14* (2006.01)

(52) U.S. Cl.
CPC ..... *B63G 8/001* (2013.01); *B63G 8/14* (2013.01); *B63G 2008/007* (2013.01)

(58) Field of Classification Search
CPC ..... B63C 11/00; B63C 11/42; B63G 8/00; B63G 8/001; B63G 8/24; B63G 8/14; B63G 8/22
USPC ..... 114/321, 330, 331, 332, 333; 405/190, 405/191
See application file for complete search history.

(56) References Cited

U.S. PATENT DOCUMENTS 3,602,300 A 8/1971 Jaffe
3,683,835 A * 8/1972 Deslierres ..... B63G 8/24 114/331
4,721,055 A * 1/1988 Pado ..... B63G 8/001 114/330
4,969,627 A 11/1990 Williams, III
5,069,580 A 12/1991 Herwig et al.
5,235,931 A * 8/1993 Nadolink ..... B63G 8/00 114/333
6,021,731 A * 2/2000 French ..... B63G 8/24 114/331
6,142,233 A 11/2000 Wilkins
(Continued)

FOREIGN PATENT DOCUMENTS

GB 2357537 A 6/2001
WO 2015/021107 A1 2/2015

OTHER PUBLICATIONS

Non-Final Office Action for the cross referenced U.S. Appl. No. 15/662,545 dated Apr. 19, 2018.
(Continued)

*Primary Examiner* — Lars A Olson
(74) *Attorney, Agent, or Firm* — Rachel Greene

(57) ABSTRACT

An underwater vehicle is configured to transfer a payload between a first location and a second location at a subsea structure. The underwater vehicle includes a payload support configured to support the payload and a buoyancy control system. The buoyancy control system includes at least one of an exchange weight system configured to receive one or more exchange weights when delivering the payload, a floatation system having one or more floatation devices coupled to the payload, or a combination thereof.

19 Claims, 9 Drawing Sheets

(56) References Cited

U.S. PATENT DOCUMENTS

| | | | | |
|---|---|---|---|---|
| 6,161,618 | A | 12/2000 | Parks et al. | |
| 6,209,565 | B1 | 4/2001 | Hughes et al. | |
| 6,223,675 | B1 * | 5/2001 | Watt | B63G 8/001 114/312 |
| 6,257,337 | B1 | 7/2001 | Wells | |
| 6,422,315 | B1 | 7/2002 | Dean | |
| 6,644,410 | B1 | 11/2003 | Lindsey-Curran et al. | |
| 6,763,889 | B2 | 7/2004 | Rytlewski et al. | |
| 6,860,525 | B2 | 3/2005 | Parks | |
| 7,213,532 | B1 * | 5/2007 | Simpson | B63C 11/42 114/331 |
| 7,216,714 | B2 | 5/2007 | Reynolds | |
| 7,216,715 | B2 | 5/2007 | Reynolds | |
| 7,222,674 | B2 | 5/2007 | Reynolds | |
| 7,690,433 | B2 | 4/2010 | Reynolds | |
| 8,020,623 | B2 | 9/2011 | Parks et al. | |
| 8,464,797 | B2 | 6/2013 | Singh et al. | |
| 8,607,879 | B2 | 12/2013 | Reynolds | |
| 8,720,579 | B2 | 5/2014 | Reynolds et al. | |
| 8,727,013 | B2 | 5/2014 | Buckley et al. | |
| 8,820,410 | B2 | 9/2014 | Parks et al. | |
| 9,416,628 | B2 | 8/2016 | Landrith et al. | |
| 9,725,138 | B2 | 8/2017 | Baylot et al. | |
| 9,797,224 | B1 | 10/2017 | Stewart et al. | |
| 9,862,469 | B1 * | 1/2018 | Drozd | B63G 8/001 |
| 10,151,151 | B2 | 12/2018 | Roper et al. | |
| 2002/0040783 | A1 | 4/2002 | Zimmerman et al. | |
| 2006/0037758 | A1 | 2/2006 | Reynolds | |
| 2007/0173957 | A1 | 7/2007 | Johansen et al. | |
| 2010/0307761 | A1 | 12/2010 | Buckley et al. | |
| 2016/0076331 | A1 | 3/2016 | Kalinec et al. | |
| 2016/0326826 | A1 | 11/2016 | Wood et al. | |
| 2018/0029678 | A1 | 2/2018 | Peterson et al. | |
| 2018/0186438 | A1 | 7/2018 | Jamieson | |
| 2018/0245417 | A1 | 8/2018 | Miller et al. | |
| 2019/0032437 | A1 | 1/2019 | Daley et al. | |
| 2019/0032439 | A1 | 1/2019 | Smith et al. | |

OTHER PUBLICATIONS

Final Office Action for the cross referenced U.S. Appl. No. 15/662,545 dated Oct. 5, 2018.

Advisory Action for the cross referenced U.S. Appl. No. 15/662,545 dated Jan. 10, 2019.

Non-Final Office Action for the cross referenced U.S. Appl. No. 15/662,545 dated Feb. 6, 2019.

Non-Final Office Action for the cross referenced U.S. Appl. No. 15/662,554 dated Jun. 27, 2019.

* cited by examiner

SYSTEMS AND METHOD FOR BUOYANCY CONTROL OF REMOTELY OPERATED UNDERWATER VEHICLE AND PAYLOAD

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Underwater vehicles, such as remotely operated underwater vehicles (ROVs), autonomous underwater vehicles, and so forth may be used in a wide range of industries to perform tasks underwater (e.g., subsea). For example, an underwater vehicle may be sent below a surface of a body of water deliver or retrieve a payload (e.g., a piece of equipment). The underwater vehicle may be designed handle payloads up to some maximum weight. Unfortunately, if the weight of the payload exceeds the maximum weight, then the underwater vehicle may not be able to deliver or retrieve the payload.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed techniques include using floatation devices and/or an exchange weight to manage the buoyancy of an underwater vehicle and its payload. Specifically, floatation devices (e.g., blocks of syntactic foam) may be attached to the underwater vehicle and the payload such that each of the underwater vehicle and the payload is within a threshold value of neutrally buoyant (i.e., the mass of the underwater vehicle and its payload are equal to the mass of the water displaced by the underwater vehicle and its payload). Further, when the underwater vehicle deposits or retrieves a payload, the underwater vehicle may exchange the payload for an exchange weight having a similar mass as the payload. Using the disclosed techniques, the underwater vehicle may retrieve or deposit heavy loads without the buoyancy of the package (i.e., the buoyancy of the underwater vehicle and the payload or exchange weight it carries) exceeding a threshold value from neutrally buoyant, such that the thrusters of the underwater vehicle can control the depth of the underwater vehicle.

Figure 1:
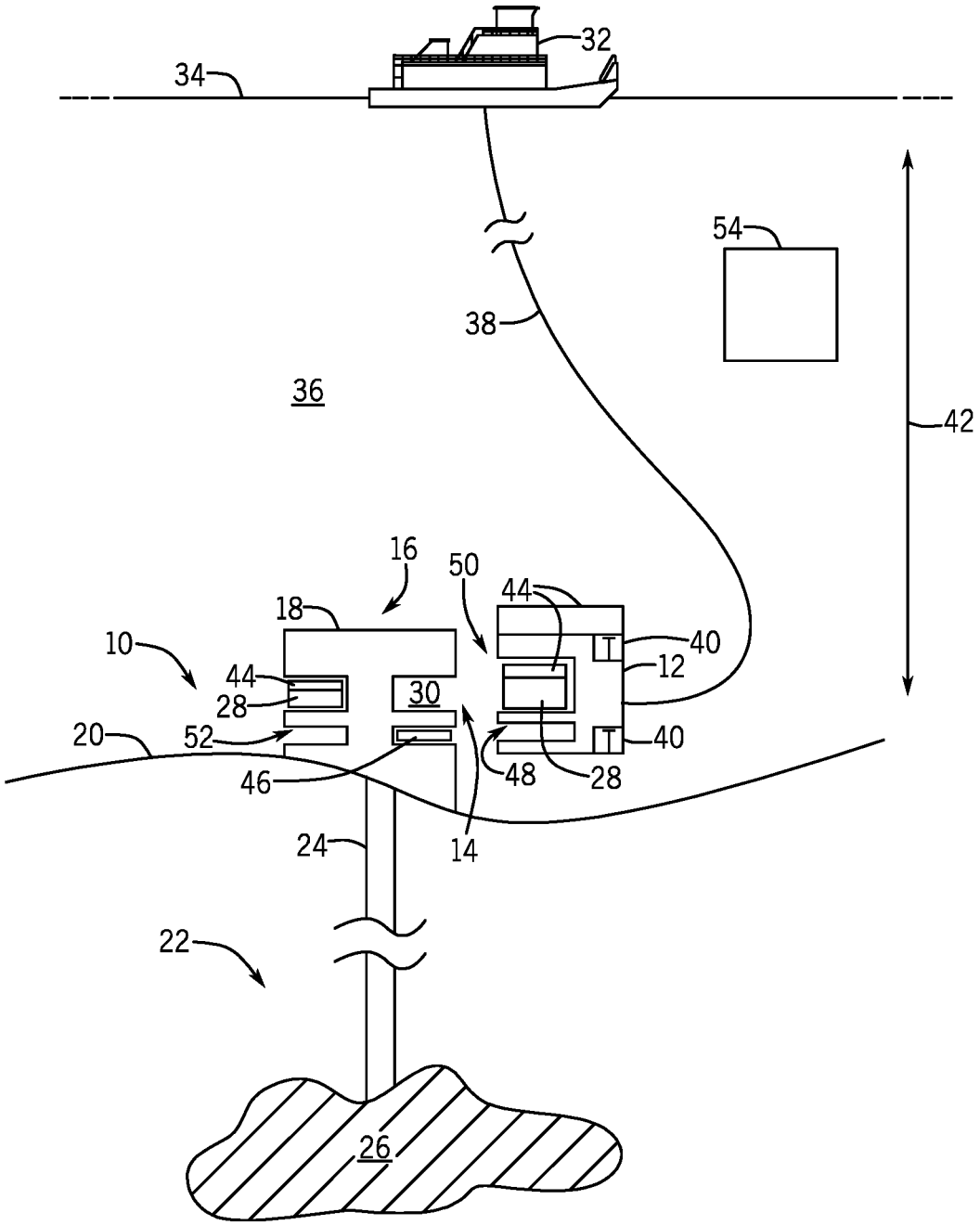
FIG. 1 is a schematic of an embodiment of a subsea installation.

FIG. 1 is a schematic of an underwater industrial application 10 (e.g., a subsea installation for hydrocarbon drilling or production) being serviced by an underwater vehicle, in this instance a remotely operated underwater vehicle (ROV) 12. It should be understood, however, that the disclosed techniques may be applied to underwater vehicles beyond ROVs. Accordingly, though the disclosed embodiments use ROVs, it should be understood that embodiments using other classes of underwater vehicles (such as autonomous underwater vehicles (AUVs) and the like) are also envisaged. In the illustrated embodiment, the industrial application 10 is a subsea installation for hydrocarbon drilling, but the disclosed techniques may be used for any underwater application that utilizes an ROV 12 to deposit or retrieve payloads 14. In the illustrated embodiment, the industrial application 10 includes a wellhead assembly 16, which may include a blowout preventer (BOP) stack 18 disposed on a sea floor 20. The wellhead assembly 16 may be part of a well 22 that includes a well bore 24 in fluid communication with a hydrocarbon deposit 26. As shown, the wellhead assembly 16 may include equipment 28 that can be deposited or retrieved by the ROV 12 (e.g., via equipment receptacles 30). The ROV 12 may be coupled to a vessel 32 (e.g., a boat, a rig, etc.) at the surface 34 of a body of water 36 via an umbilical cord 38 extending from the vessel 32 to the ROV 12. The umbilical cord 38 may provide power, control signals, communication, etc. to the ROV 12. In some embodiments, an intermediate docking station 54 may be disposed at an intermediate depth between the surface 34 and the sea floor 20. The ROV 12 may dock at the intermediate docking station 54 for storage or to retrieve or deposit payloads 14, exchange weights 46, floatation devices 44, or other cargo.

The ROV 12 may include one or more thrusters 40, which provide thrust to control the location and motion of the ROV 12. The thrusters 40 may be variable (i.e., the direction of thrust for each thruster 40 is variable) or fixed (i.e., the direction of thrust for each thruster 40 is fixed), such that the thrusters may be used in concert to move the ROV 12 laterally within the body of water 36, and/or to control a depth 42 of the ROV 12 within the body of water 36. Accordingly, the ROV 12 and payload 14 need not be perfectly neutrally buoyant to adjust the depth 42 of the ROV 12. That is, as long as the combined mass or weight of the ROV 12 and payload 14 is within a threshold value (e.g., 1,000 lbs) of the neutrally buoyant mass, the thrusters 40 may be used control the depth 42 of the ROV 12 within the body of water 36. In other embodiments, the threshold may be in the range of 100 lbs to 2500 lbs, or some other value. In some instances, the mass of the payload may far exceed the threshold value. As will be understood, the ROV 12 may be loaded with the payload 14 (e.g., equipment 28) such that the combined mass of the ROV 12 and the payload 14 ("package mass") is within the threshold value of the neutrally buoyant mass. However, once the ROV 12 deposits the payload 14 at the desired location (e.g., the equipment 28 is deposited in the equipment receptacle 30), because the mass of the payload is zero or has been reduced, the package mass may no longer be within the threshold value of the neutrally buoyant mass. Accordingly, the thrust provided by the thrusters 40 may be insufficient in controlling the depth 42 of the ROV 12 as it returns back to the surface 34. Similarly, if the ROV 12 is sent to retrieve a payload 14, the package mass may be within the threshold value of the neutrally buoyant mass on the way down (e.g., no payload 14 or small payload 14), but once the ROV 12 retrieves the payload 14 at the subsea location, the package mass may far exceed the neutrally buoyant mass, beyond a threshold value. In such an instance, the thrusters 40 would be unable to provide enough thrust to return the ROV 12 to the surface 34. To address this challenge, exchange weights and floatation devices (e.g., blocks of syntactic foam) may be used individually or in combination to maintain the package mass within the threshold value of the neutrally buoyant mass, or to maintain the package buoyancy within a threshold value of neutrally buoyant.

For example, in the illustrated embodiment, both the ROV 12 and the payload 14 (e.g., equipment 28) may be outfitted with one or more floatation devices 44. The floatation devices 44 may include blocks of foam, or other devices that increase the buoyancy of the ROV 12 and/or the payload 14. For example, in some embodiments, the floatation devices may include composite materials synthesized by filling a metal, polymer, or ceramic matrix with hollow spheres called microballoons or cenospheres or non-hollowspheres, otherwise known as syntactic foam. Though the described embodiments utilize blocks of syntactic foam as the floatation device 44, it should be understood that the disclosed techniques may be utilized with any device that increases buoyancy (e.g., ballast tanks, etc.). The ROV 12 and the payload 14 each may be outfitted with one or more floatation devices, such that the ROV 12 and the payload 14 are individually within a threshold mass or buoyancy of neutral buoyancy, and such that combined ROV 12 and payload 14 are close enough to neutrally buoyant that the thrusters 40 may be used to control the depth of the ROV 12 when carrying the payload 14. However, when the ROV 12 deposits the payload 14, the floatation devices 44 coupled to the payload 14 are also deposited, such that the ROV 12 is close enough to neutrally buoyant that the thrusters 40 may be used to control the depth of the ROV 12 without the payload 14. In the illustrated embodiment, the floatation devices 44 are disposed at or near the top of the ROV 12 and the payload 14, such that the floatation devices 44 do not cause the ROV 12 or the payloads 14 to roll. By making each component in the package (ROV 12, payloads 14, etc.) within threshold values of neutrally buoyant, the various components may be coupled to one another and decoupled from one another without reaching a buoyancy that renders the thrusters 40 unable to control the depth of the ROV 12.

In some embodiments, the ROV 12 may also use an exchange weight 46 technique instead of, or in addition to, using floatation devices 44. For example, the ROV 12 may be equipped with an exchange weight receptacle 48. The exchange weight 46 may have a similar mass and/or buoyancy as the payload 14. Accordingly, to deposit a payload 14, the payload 14 is loaded on the ROV 12 and the ROV 12 dives to the deposit location. The ROV 12 then docks to the subsea structure (e.g., wellhead assembly 16) using a docking system 50. The payload 14 (e.g., equipment 28) is then deposited in the equipment receptacle 30 and an exchange weight 46 is retrieved from an exchange weight receptacle 52 of the wellhead assembly 16 and stored in the exchange weight receptacle 48 of the ROV 12. Though a single exchange weight 46 and corresponding exchange weight receptacles 48, 52 are shown, it should be understood that embodiments having one or more exchange weights 46 and corresponding receptacles 48, 52 (e.g., 1, 2, 3, 4, 5, 6, 7, 8, 9, 10, or more) are also envisaged. Further, such embodiments may include exchange weights 46 and receptacles 48, 52 of different weights, sizes, etc. The docking system 50 then decouples the ROV 12 from the wellhead assembly 16 and the ROV 12 returns to the surface 34. Because the exchange weight 46 has a mass and/or buoyancy substantially equal or similar to that of the payload 14, the buoyancy of the total package does not substantially change when the payload 14 is exchanged for the exchange weight 46. Thus, the thrusters 40 are capable of returning the ROV 12 to the surface 34.

Similarly, to retrieve a payload 14, the ROV 12 is equipped with an exchange weight 46 and the ROV 12 dives to the payload 14 to be retrieved. The ROV 12 then docks to the wellhead assembly 16 using the docking system 50. The payload 14 (e.g., equipment 28) is then retrieved from the equipment receptacle 30 and the exchange weight 46 is deposited in the exchange weight receptacle 52 of the wellhead assembly 16. The docking system 50 then decouples the ROV 12 from the wellhead assembly 16 and the ROV 12 returns to the surface 34 with the payload 14. Because the exchange weight 46 has a mass and/or buoyancy substantially equal or similar to that of the payload 14, the buoyancy of the total package does not substantially change when the payload is retrieved and the exchange weight 46 deposited, thus the thrusters 40 are capable of returning the ROV 12 to the surface 34.

Figure 2:
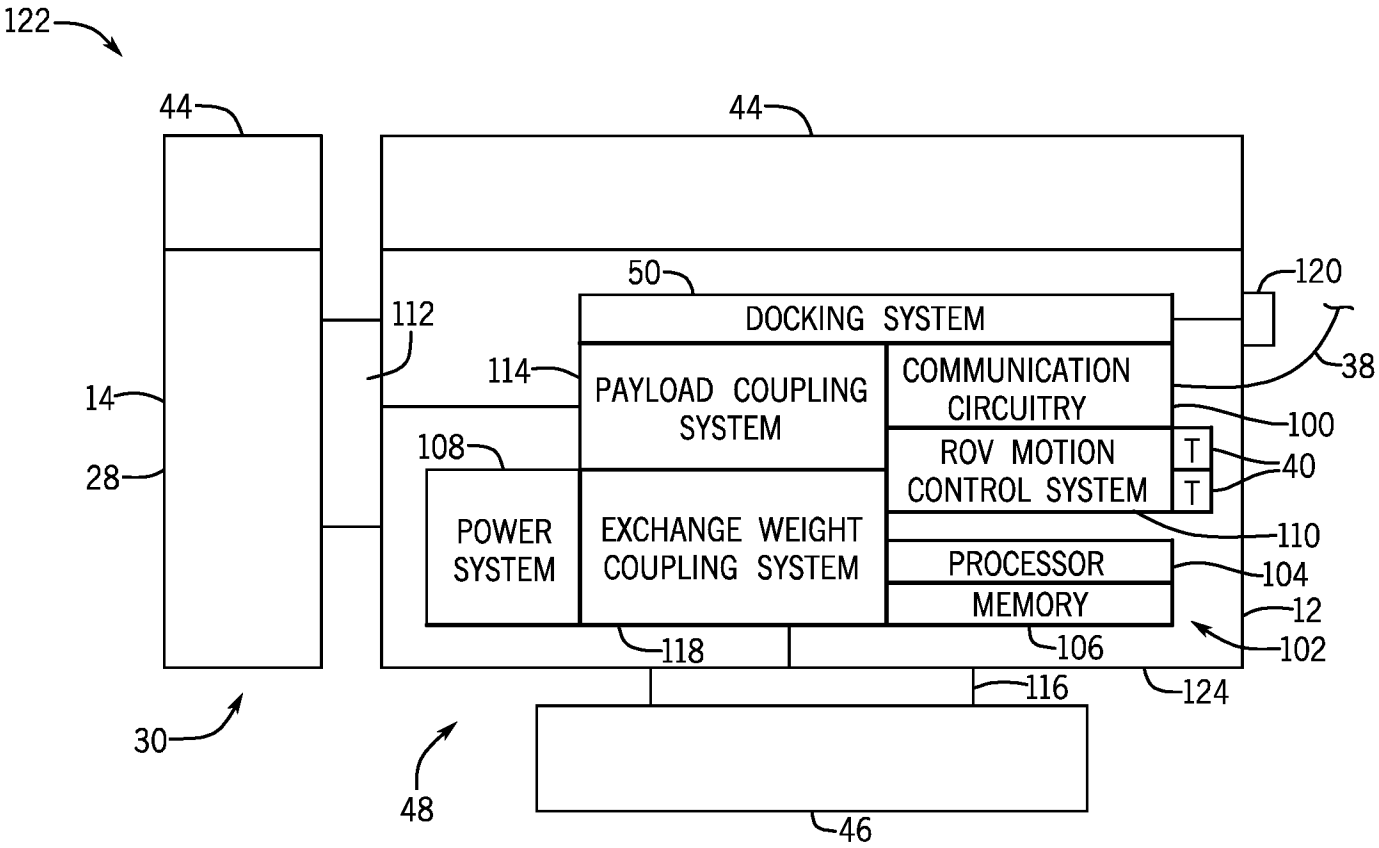
FIG. 2 is a schematic of an embodiment of an ROV used to service the subsea installation shown in FIG. 1.

FIG. 2 is a schematic of the ROV 12 shown in FIG. 1. As previously described, the ROV 12 may receive signals (e.g., power, communication, control signals, etc.) via the umbilical cord 38. The umbilical cord 38 may be in communication with communication circuitry 100, which may provide the signals to an ROV control system 102. For example, the control system 102 may include a processor 104 and a memory component 106. The memory component 106 may store data, such as computer programs, code, received or collected data, etc. The processor 104 may run programs or code stored on the memory component 106. In some instances, the processor 104 may analyze data stored on the memory component 106. The control system 102 may control the various other components of the ROV 12.

The ROV 12 includes a power system 108. As previously described, the ROV 12 may receive power via the umbilical cord 38. In such embodiments, the communication circuitry 100 may route a power signal to the power system 108, which may provide power to the various components within the ROV 12. In some embodiments, the power system 108 may include a battery, capacitor, or some other energy storage device.

The ROV 12 also includes a propulsion system or motion control system 110, which may include the thrusters 40 discussed above with regard to FIG. 1, or one or more other propelling devices. The thrusters 40 and or the motion control system 110 may include, for example, one or more generators, motors, hydraulic pumps, hydraulic motors, hydraulic cylinder, drive components, propellers, compressed gas/air/fluid reservoirs and outlets, etc. The motion control system may control the direction and/or thrust provided by the one or more propelling devices 40 to control the position of the ROV 12. By maintaining buoyancy within a threshold value of neutral buoyancy, the size, thrust, power, etc. of the thrusters may be reduced, enabling a less powerful motion control system 110 to handle larger loads than previously possible.

As previously discussed, the ROV 12 may couple to a payload 14 (e.g., equipment 28). Accordingly, the ROV 12 may include payload coupling hardware 112 (e.g., receptacles, grabbing arms, clamps, snap-fit couplings, etc.) that acts as an interface between the ROV 12 and the payload 14. In some embodiments, the payload coupling hardware 112 may include male and female components mounted on the ROV and the payload 14 that couple to one another. In other embodiments, the payload coupling hardware 112 may not have corresponding hardware on the payload 14. As shown in FIG. 1, the payload 14 may be received in a receptacle 30 of the ROV 12. In some embodiments, the ROV may include multiple payload receptacles 30, or the same or different sizes, to accommodate multiple payloads 14. In some embodiments, the receptacle 30 may not completely enclose the payload. For example, the ROV 12 may couple to the payload 14 via the payload coupling hardware 112 without pulling the payload into an enclosed receptacle (i.e., the payload coupling hardware 112 may just grab the payload 14). The payload coupling hardware 112 may be under the control of a payload coupling system 114, which controls when and how the ROV 12 couples to the payload 14.

Similarly, in embodiments in which the exchange weight 46 is used to control buoyancy of the ROV 12, the ROV may include exchange weight coupling hardware 116 (e.g., brackets, gripping arms, trolleys, tracks, ratcheting systems, wenches, clamps, snapfit couplings, etc.) controlled by an exchange weight coupling system 118. As with the payload coupling hardware 112, the exchange weight coupling hardware 116 may include male and female components mounted on the ROV and the exchange weight 46 that couple to one another. In other embodiments, the exchange weight coupling hardware 116 may not have corresponding hardware on the exchange weight 46. As shown in FIG. 1, the exchange weight 46 may be received in a one or more receptacles 48 of the ROV 12. In embodiments with multiple exchange weights and receptacles, the receptacles may be of the same or different sizes to allow a customization of the one or more exchange weights 46. As with the payload receptacle, in some embodiments, the receptacle 48 may not completely enclose the exchange weight 46. The example, the ROV 12 may couple to the exchange weight 46 via the exchange weight coupling hardware 116 without pulling the exchange weight 46 into an enclosed receptacle (i.e., the exchange weight coupling hardware 116 may just grab the exchange weight 46). The exchange weight coupling hardware 116 may be under the control of an exchange weight coupling system 118, which controls when and how the ROV 12 couples to the exchange weight 46. The exchange weight 36 may be a one or more solid blocks of material (e.g., lead, steel, etc.), or a container that may be selectively filled with a liquid or granular material to achieve a desired mass.

In embodiments in which the ROV 12 docks to the wellhead assembly 16, or other structure, the ROV may be outfitted with the docking system 50, which may include docking hardware 120 (e.g., brackets, gripping arms, trolleys, tracks, ratcheting systems, wenches, clamps, snapfit couplings, etc.). In such an embodiment, the motion control system 110 may be used to position the ROV 12, at which point the docking hardware 120, under the control of the docking system 50, engages with a structure (e.g., wellhead assembly 16) to secure the ROV 12. Once docked, the ROV 12 may retrieve or deposit the payload 14, the exchange weight 46, or other objects. While the ROV 12 is docked, the buoyancy of the package 122 (e.g., ROV 12, payload 14, exchange weight 46, etc.) may exceed the buoyancy window of the motion control system 110 (i.e., the buoyancy range in which the motion control system 110 is capable of controlling the ROV 12 within a body of water), because the ROV 12 relies on the wellhead assembly 16, or other structure to remain stationary.

As previously discussed, in some embodiments, the ROV 12, the payload 14, or both, may include floatation devices 44 (e.g., blocks of syntactic foam) for increasing the buoyancy of the ROV 12 and/or payload 14. As previously discussed, if the buoyancy of the package 122 is within a threshold value of neutrally buoyant, the motion control system 110 can control the depth of the ROV 12. However, if the buoyancy of the package 122 is beyond a threshold value above neutrally buoyant, the ROV 12 will float to the surface 34. Correspondingly, if the buoyancy of the package 122 is beyond a threshold value below neutrally buoyant, the ROV 12 will sink to the sea floor 20. Accordingly, the ROV 12 and the payload 14 may each be outfitted with floatation devices 44 such that the ROV 12 and the payload 14 are each individually within the threshold value of neutrally buoyant, and the package 122 is also within the threshold value of neutrally buoyant when the ROV 12 and the payload 14 are coupled to one another. In such a configuration, the ROV 12 and payload 14 may couple to one another and decouple from one another without exceeding the threshold value from neutral buoyancy.

The ROV 12 may include or be attached to a frame 124 (e.g., skid). The payload coupling hardware 112, the exchange weight coupling hardware 116, and the docking hardware 120 may be coupled to the frame 124 and provide an interface between the ROV 12 and other components (e.g., payload 14, exchange weight 46, wellhead assembly 16, etc.). Specific embodiments of the frame are discussed in more detail below.

Figure 3:
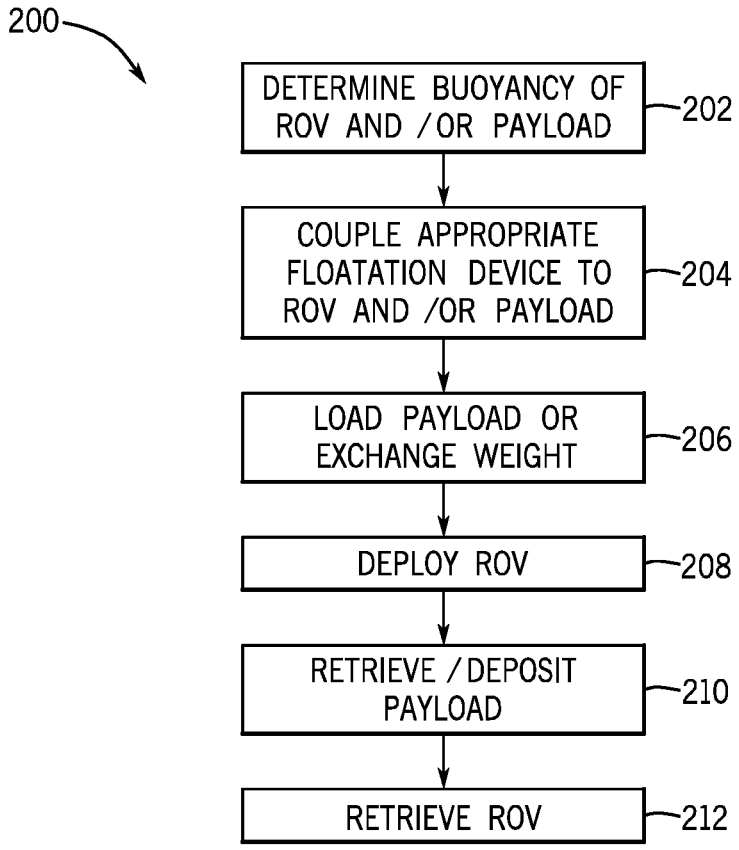
FIG. 3 is a flow chart of an embodiment of a process for controlling buoyancy of the ROV of FIG. 2 while depositing and/or retrieving a payload.

FIG. 3 is a flow chart of a process 200 for controlling buoyancy of an ROV 12 while depositing and/or retrieving the payload 14. In block 202, the buoyancy of the ROV 12 and/or payload 14 is determined, either experimentally (e.g., water displacement test), or by measuring the mass and volume. As previously discussed, the motion control system 110 (e.g., one or more thrusters 40) of the ROV 12 may be capable controlling the depth 42 of the ROV 12 as long as the buoyancy of the package 122 is within a threshold value of neutrally buoyant. In some embodiments, if the package 122 as a whole, or the ROV 12 and payload 14 individually, do not fall within the threshold value of neutrally buoyant, floatation devices 44 may be added to either the ROV 12, the payload 14, or both (block 204) in order to achieve the desired buoyancies and buoyancy distribution. For example, blocks of syntactic foam may be coupled to the ROV 12 and/or the payload such that the combined package 122 and the individual elements of the package 122 (e.g., the ROV 12 and the payload 14) may have buoyancies within a threshold range of neutrally buoyant such that the ROV motion control system 110 can control the depth 42 of the ROV 12 with and without the payload 14.

In block 206 the payload 14 or the exchange weight 46 is loaded onto the ROV 12. If the ROV 12 is taking a payload 14 down to deposit at a location, then the payload 14 is loaded onto the ROV 12. Alternatively, if the ROV 12 is retrieving a payload 14, then the ROV 12 may be loaded with an exchange weight 46. The mass of the exchange weight 46 may be determined based upon the mass of the payload 14. For example, the exchange weight 46 may be selected such that the exchange weight 46 and the payload 14 have substantially similar masses, such that the ROV motion control system 110 may be capable of controlling the depth 42 of the ROV 12 when loaded with either the payload 14 or the exchange weight 46.

In block 208, the ROV 12 is deployed from a location at or near the surface 34 or an intermediate docking station 54 to a location, diving a depth 42 to a second location (e.g., a wellhead assembly 16 at or near the sea floor 20). Once the ROV 12 arrives at the location, the payload 14 is deposited or retrieved (block 210). In some embodiments, the ROV 12 may couple (e.g., dock) to a structure at the location (e.g., wellhead assembly 16) via docking hardware 120 under the control of the docking system 50. By docking to the wellhead assembly 16 or other structure, the ROV 12 may deposit or retrieve payloads 14 and/or exchange weights 46 without maintaining a package 122 buoyancy within the threshold buoyancy of neutrally buoyant without the ROV 12 sinking or floating away. However, in some embodiments, the ROV 12 may not dock. Once the payload 14 and/or exchange weight 46 have been deposited or retrieved, the ROV 12 may undock, if the ROV 12 docked to the wellhead assembly 16. The ROV 12 then returns to the location at or near the surface 34 or the intermediate docking station. The ROV may then be retrieved (block 212) and unloaded.

Figure 4:
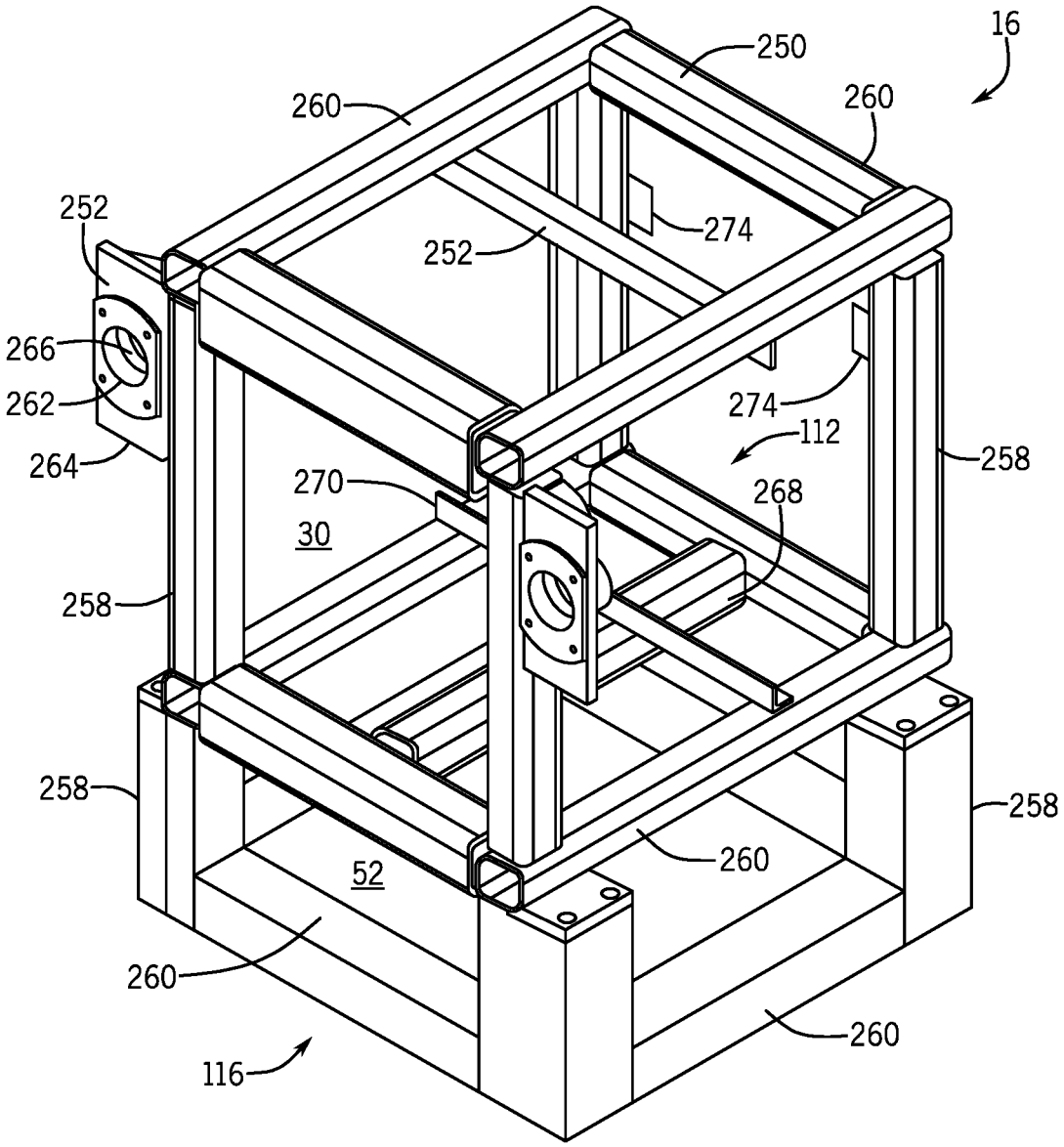
FIG. 4 is a perspective view of an embodiment of a portion of a subsea frame for receiving the payload of FIG. 3 and/or an exchange weight.

FIG. 4 is a perspective view of an embodiment of a portion of a subsea frame 250 for receiving the payload 14 and/or the exchange weight 46. The frame 250 may be part of the wellhead assembly 16 shown in FIG. 1, or some other submerged system. As shown, the frame 250 includes an exchange weight receptacle 52 configured to receive the exchange weight 46, and an equipment receptacle 30 configured to receive the payload 14. However, in certain embodiments, the frame 250 may include any number (e.g., 1, 2, 3, 4, 5, 6, 7, 8, 9, 10, or more), size, geometry, and/or configuration of receptacles 30 and 52. The frame 250 includes docking hardware 252, mounting hardware 254, payload coupling hardware 112, and exchange weight coupling hardware 116 configured to facilitate insertion and removal of packages (e.g. 14 and 46) via the ROV 12. As illustrated, the frame 250 includes a plurality of interconnected beams or supports 256, which include vertical supports 258 and horizontal supports 260. Collectively, the supports 256 of the frame 250 define the receptacles 30 and 52.

The docking hardware 252, mounting hardware 254, payload coupling hardware 112, and exchange weight coupling hardware 116 are coupled to the frame 250. For example, the docking hardware 252 may include one or more docking joints or couplings 262 (e.g., first and second spaced couplings), which may include respective docking plates 264 and receptacles 266 (e.g., circular receptacles, indents, or passages). In some embodiments, the couplings 262 may include male and/or female couplings 262, which removably couple with docking hardware 120 (e.g., docking joints or couplings) on the ROV 12. For example, the ROV 12 may include docking couplings (e.g., male joints, detents, or arms) that extend into and interlock with the receptacles 266 of the couplings 262. In certain embodiments, the docking couplings 262 include two circular receptacles 266 (e.g., indents) on either side of the frame 250, which may interface with complementary docking hardware 120 (e.g., two detents on the ROV 12) to secure the ROV 12 to the frame 250 while the payload 14 and/or exchange weight 46 are being deposited or retrieved. The mounting hardware 254 may include one or more guide rails 268 and package stops 270. The guide rails 268 extend lengthwise along the receptacles 30 and 52 in a direction of insertion or removal of the packages (e.g., 14 and 46), while the stops 270 may extend crosswise into the receptacles 30 and 52 to limit a depth of insertion. The payload coupling hardware 112 and exchange weight coupling hardware 116 may be disposed in one or more portions of the receptacles 30 and 52, and may include one or more joints or couplings (e.g., male and/or female couplings). For example, the hardware 112 and 116 may include mating structures, such as male and female tracks or rails, male and female latch assemblies, male and female snap-fit structures, mating protrusions and recesses, mating hooks and receptacles, mating detents and indentions, magnetic couplings, or any combination thereof.

In certain embodiments, the frame 250 may include any number, size, geometry, and configuration of receptacles 30 and 52. For example, the frame 250 may include a plurality of uniform receptacles 30 and/or 52, a plurality of different receptacles 30 and/or 52, or a combination thereof. By further example, the receptacles 30 and/or 52 may be arranged vertically one over another, horizontally side by side, or distributed throughout the submerged system. In embodiments with equally sized receptacles 30 and 52, the frame 250 is configured to facilitate exchange of equally sized payloads 14 and exchange weights 46 with the ROV 12. In embodiments with differently sized receptacles 30 and 52, the frame 250 is configured to facilitate exchange of differently sized payloads 14 and exchange weights 46 with the ROV 12; however, the ROV may exchange multiple smaller packages (e.g., 14 or 46) with fewer (e.g., one) larger packages (e.g., 14 or 46) in certain applications. In other words, the exchange of packages (e.g., 14 and 46) between the ROV 12 and the frame 250 may be a ratio of greater than, less than, or equal to 1:1, 1:2, 1:3, 1:4, 1:5, 1:10, or vice versa.

Furthermore, the frame 250 may be configured to support a plurality of exchange weights 14 in respective receptacles 52, such that the ROV 12 may be configured to selectively retrieve one or more of the exchange weights 14 to obtain a desired buoyancy suitable for a return trip to the surface. For example, each of the exchange weights 14 may have an equal or different weight, which may be used alone or in combination with one another to define a desired weight when retrieved by the ROV 12. Similarly, each of the exchange weights 14 may have an equal or different buoyancy, which may be used alone or in combination with one another to define a desired buoyancy when retrieved by the ROV 12. In certain embodiments, the exchange weights 14 may include a solid, liquid, or gas material configured to define a desired weight or buoyancy.

In some embodiments, the frame 250 may also support components 272 that interface with the payload 14 once deposited in the equipment receptacle 30. For example, these components may have fluid, hydraulic, electrical, pneumatic, or other connectors that interface with the payload 14. Accordingly, the frame 250 may include mounting hardware 274 for mounting these components, which may remain coupled to the frame 250 as the payload 14 is deposited and retrieved. Such mounting hardware may include cross-members, brackets, etc.

It should be understood, however that the frame 250 shown in FIG. 4 is merely one possible embodiment and that other configurations are also envisaged. For example, the frame 250 may have a different shape than the frame 250 shown. Further, the frame 250 may not completely enclose the equipment receptacle 30 and/or the exchange weight receptacle 52. The equipment receptacle 30 and the exchange weight receptacle 52 may be in different positions relative to one another than shown in FIG. 4. Further, the docking hardware 252 may include a different number of locations (e.g., 1, 3, 4, 5, 6, 7, 8, 9, 10, or more locations), which may be positioned differently than is shown in FIG. 4. Additionally, the docking hardware 252 may have a different geometry and interface with the corresponding docking hardware 120 on the ROV 12 in a different way than is shown in FIG. 4.

Figure 5:
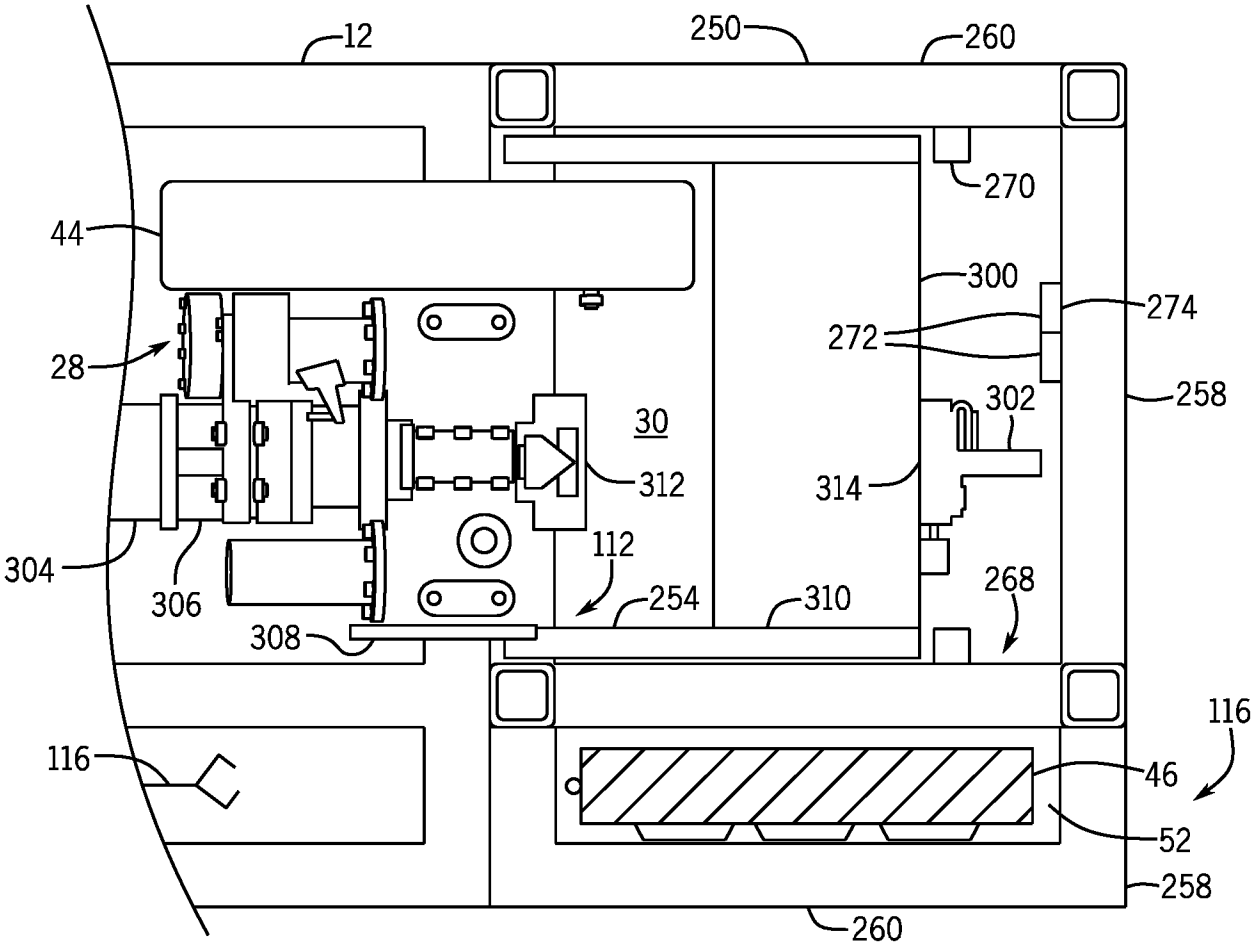
FIG. 5 is a side, section view of an embodiment of the ROV depositing the payload in an equipment receptacle of the subsea frame of FIG. 4.

FIG. 5 is a side, section view of the ROV 12 depositing a payload 14 (e.g., piece of equipment 28) in the equipment receptacle 30 of the subsea frame 250. As shown, the ROV 12 has docked with the frame 250 (e.g., via docking hardware 120, 252) and is in the process of depositing the piece of equipment 28 in the equipment receptacle of the frame 250. As shown, the frame 252, which may be part of the wellhead assembly 16, includes a component 300 (e.g., a receiver), which is coupled to the frame 252 via component mounting hardware 254. The component 300 may include fluid, hydraulic, pneumatic, electrical, or other connectors (e.g., disposed on a back panel 302 of the receiver 300) that interface with complementary connectors on the piece of equipment. As shown, a torque tool 304 of the ROV 12 interfaces with a torque tool bucket 306 of the piece of equipment 28. A guide 308 disposed on the bottom of the piece of equipment may interface with a base plate 310 of the receiver, which may include a groove through which the guide 308 moves. The ROV 12 may utilize the torque tool 304 to push the piece of equipment 28 into the equipment receptacle 30. Once the piece of equipment 28 is fully inserted into the equipment receptacle, a latch 312 of the piece of equipment 28 may be actuated by the ROV 12 (e.g., via the torque tool 304 and the torque tool bucket 306) to couple to a coupling 314 of the receiver 300. In the illustrated embodiment, the ROV 12 retrieves the exchange weight 46 from the exchange weight receptacle 52 after the piece of equipment 28 has been deposited within the equipment receptacle 30. However, in other embodiments, the exchange weight 46 may be retrieved before the piece of equipment 28 is deposited, or while the piece of equipment 28 is being deposited.

Figure 6:
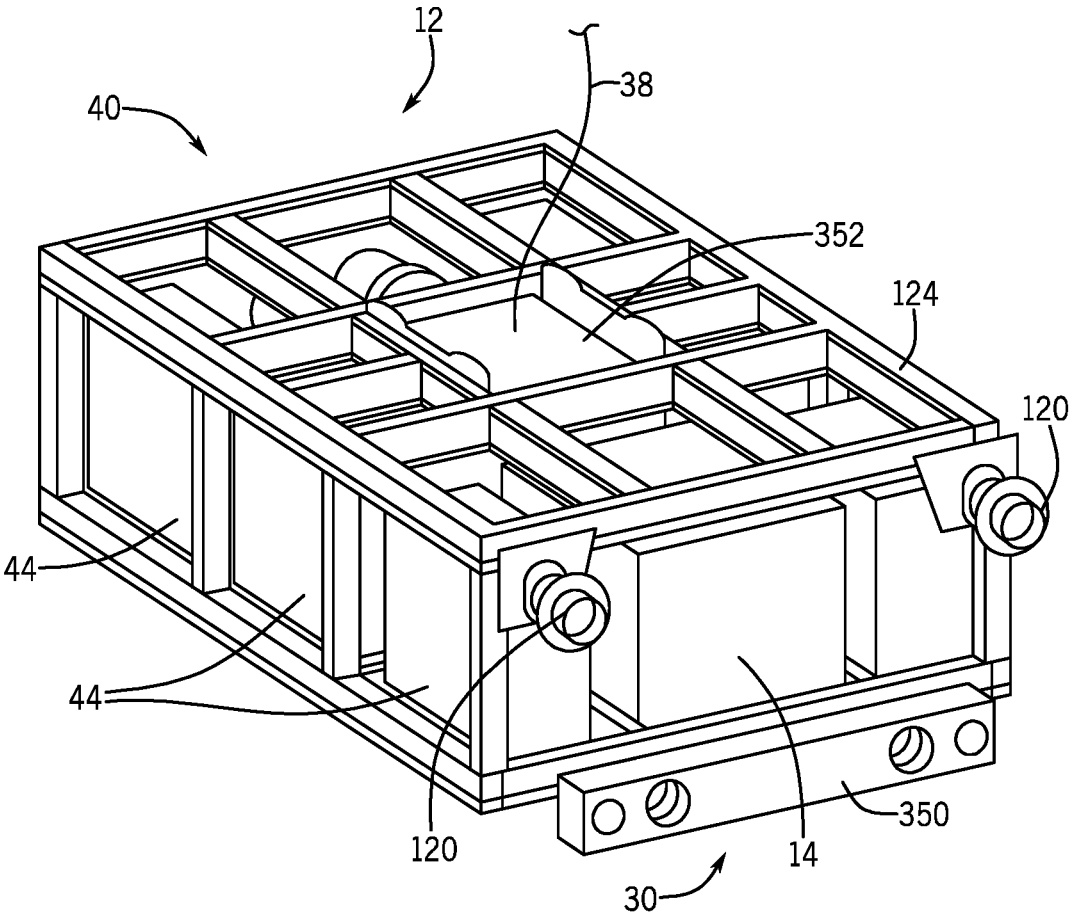
FIG. 6 is a perspective view of an embodiment of the ROV.
Figure 7:
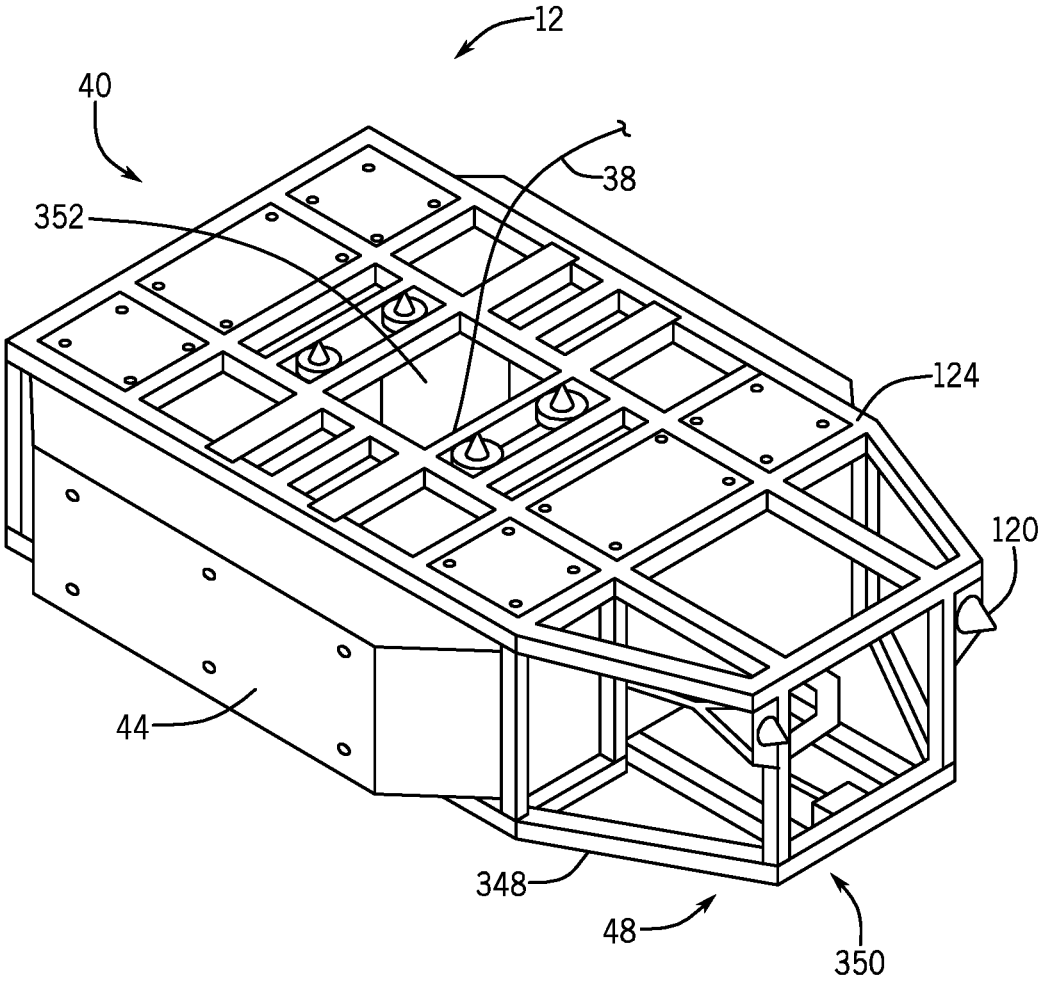
FIG. 7 is a perspective view of an embodiment of the ROV.

FIGS. 6 and 7 illustrated perspective views of embodiments of the ROV 12 shown in FIG. 1. FIG. 6 is a perspective view of one possible embodiment of the ROV 12. As illustrated, the ROV 12 includes the frame 124. Docking hardware 120 mounted to the frame 124 interfaces with complementary docking hardware 252 on the subsea framework 250 shown in FIG. 4. As previously discussed, the docking hardware 120 shown in FIG. 6 is just one of many possible embodiments. Accordingly, the docking hardware 120 may take different forms in other embodiments. The ROV 12 also includes a bumper 350 to facilitate docking to the wellhead assembly 16 and reduce damage or wear to the ROV frame 124 or the subsea frame 250. For example, the bumper 350 may include one or more shock absorption structures, such as one or more resilient portions (e.g., bumpers made of a resilient material such as rubber) or shock absorbers (e.g., piston-cylinder assemblies or fluid filled resilient bags). In the illustrated embodiment, a plurality of floatation devices 44 are disposed within the frame 124, rather than on top of the frame 124. However, the centers of mass of the various floatation devices may be disposed even with or above the center of mass of the rest of the ROV 12 and/or payload 14, so as not to induce rolling. A central housing 352 may be disposed interior of the frame 124 and include many of the components and systems shown and described with regard to FIG. 2. For example, the central housing 352 may include all of or part of the communication circuitry 100, the ROV control system 102, the ROV power system 108, the ROV motion control system 110, the payload coupling system 114, the exchange weight coupling system 118, etc. The thrusters 40 may be disposed at the rear of the ROV 12 and act under the control of the motion control system 110 to control the position of the ROV 12. As illustrated, a payload 14 is disposed within the equipment receptacle 30. Once the ROV 12 docks with the subsea frame 250 (e.g., via the docking hardware 120), the payload may be transferred to the equipment receptacle 30 of the subsea frame 250. In the illustrated embodiment, the ROV 12 does not have an exchange weight receptacle 48. Accordingly, the ROV 12 may rely entirely on floatation devices 44 mounted to the ROV 12 and/or the payload 14 for buoyancy control. However, the ROV 12 shown in FIG. 7 could be modified to include one or more exchange weight receptacles 48 and corresponding hardware 116. Accordingly, embodiments of the ROV 12 may utilize floatation devices 44, exchange weights 46, or a combination thereof to manage the buoyancy of the ROV 12.

FIG. 7 is a perspective view of another embodiment of the ROV 12. The ROV 12 includes the frame 124 and docking hardware 120 mounted to the frame 124, which interfaces with complementary docking hardware 252 on the destination framework 250 shown in FIG. 4. However, the docking hardware 120 may take different forms than those shown in FIG. 7. The ROV 12 also includes the bumper 350 to facilitate docking to the wellhead assembly 16 and reduce damage or wear to the ROV frame 124 or the subsea frame 250. In addition, the bumper 350 is coupled to a front tapered guide portion 348, which may help to gradually guide the ROV 12 into the receptacle 52 in the subsea frame 250, while the bumper 350 may provide some shock absorption. The floatation devices 44 are disposed mostly within the frame 124, rather than on top of the frame 124, with the centers of mass of the various floatation devices disposed even with or above the center of mass of the rest of the ROV 12 so as not to induce rolling. In the illustrated embodiment, the central housing 352 is disposed interior of the frame 124 and may include all of or part of the communication circuitry 100, the ROV control system 102, the ROV power system 108, the ROV motion control system 110, the payload coupling system 114, the exchange weight coupling system 118, etc. The thrusters 40 may be disposed at the rear of the ROV 12 and act under the control of the motion control system 110 to control the position of the ROV 12. As illustrated, the equipment receptacle 48 is empty, however, once the ROV 12 docks to a subsea frame 12, it may retrieve a payload 14 (e.g., a piece of equipment 28) and store the payload 14 in the equipment receptacle 48. As with the ROV shown in FIG. 7, the ROV 12 does not have an exchange weight receptacle 48. Accordingly, the ROV 12 may rely entirely on floatation devices 44 mounted to the ROV 12 and/or the payload 14 for buoyancy control. However, the ROV 12 shown in FIG. 7 could be modified to include an exchange weight receptacle 48 and corresponding hardware 116. Accordingly, embodiments of the ROV 12 may utilize floatation devices 44, exchange weights 46, or a combination thereof to manage the buoyancy of the ROV 12.

Figure 8:
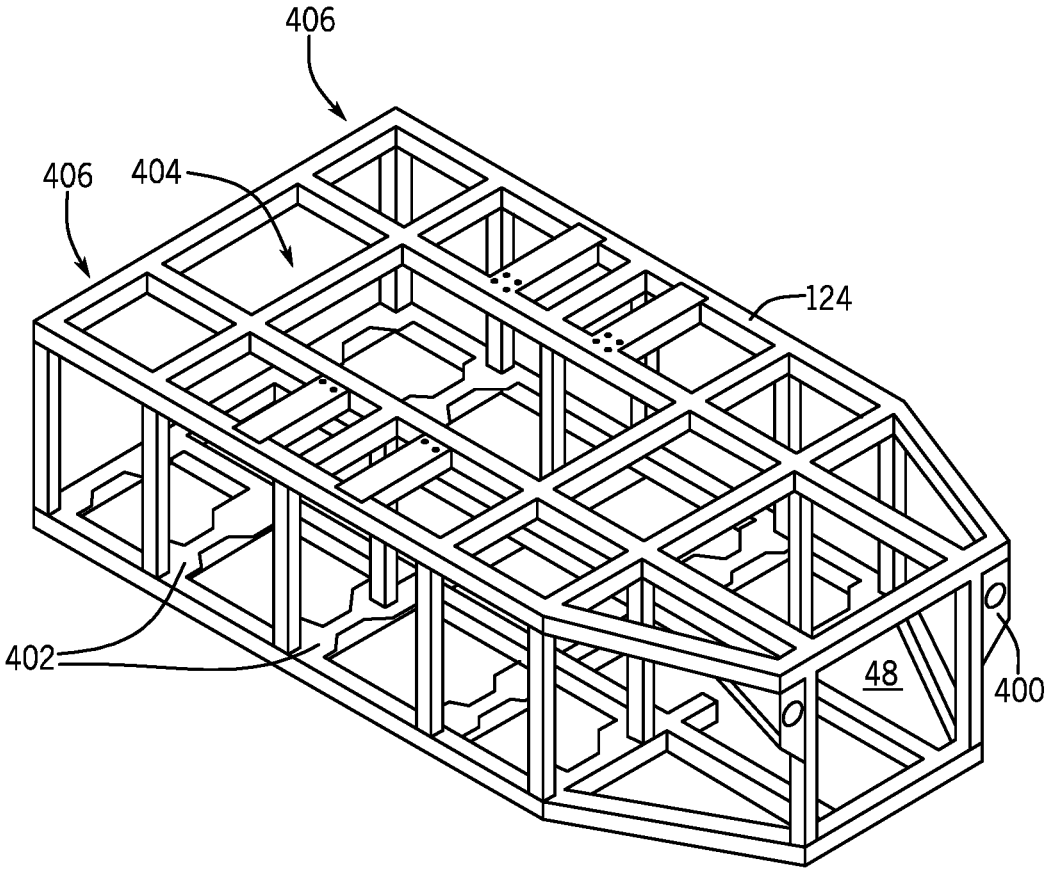
FIG. 8 is a perspective view of a frame of the embodiment of the ROV shown in FIG. 7.

FIG. 8 is a perspective view of the frame 124 of the ROV 12 shown in FIG. 7. As illustrated, the frame 124 includes docking hardware brackets 400 for mounting docking hardware 120. Similarly, the frame may include mounting brackets 402, which may facilitate mounting floatation devices 44, thrusters 40, or central housings 352. As shown, a central channel 404 may be used for holding payloads 14, central housings 352, and the like. Meanwhile, side channels 406 may be used for floatation devices 44.

Figure 9:
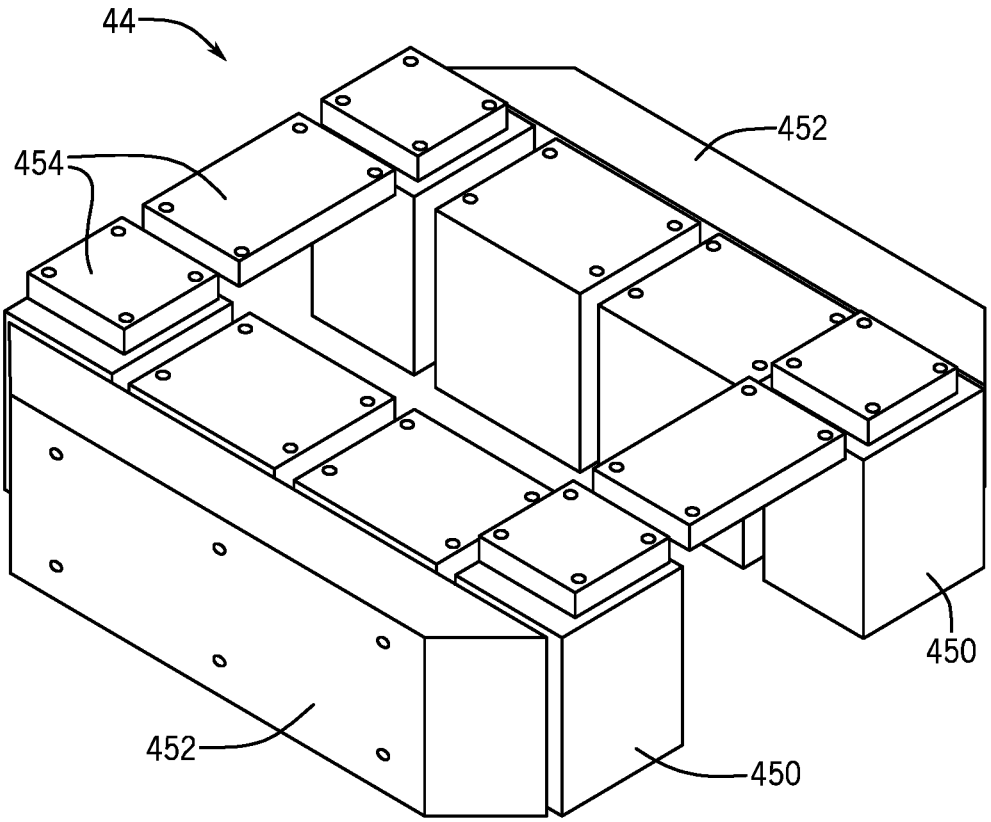
FIG. 9 is a perspective view of floatation devices of the embodiment of the ROV shown in FIG. 7.

FIG. 9 is a perspective view of the floatation devices 44 of the ROV 12 shown in FIG. 7. As illustrated, the floatation devices 44 may include multiple different kinds of floatation devices 44. For example, in the instant embodiment, the ROV 12 is equipped with internal floatation devices 450, side floatation devices 452, and top floatation devices 454. The internal floatation devices 450 are disposed within the frame 124. The side floatation devices 452 are coupled to the frame 124 but extend outward beyond the frame 124 toward either side of the frame 124. The top floatation devices 454 may be coupled to the frame 124 and disposed on top of the internal floatation devices. As previously discussed, the configuration show in FIG. 10 (i.e., internal floatation devices 450, side floatation devices 452, and top floatation devices 454) is just one of many possible embodiments. In the illustrated, the floatation devices 44 are made of syntactic foam, but any other buoyancy-increasing material may be used. Furthermore, the floatation devices 44 may be selectively and removably coupled to the frame 124 of the ROV 12 (e.g., on-site or off-site) to tailor the buoyancy of the ROV 12 based on the expected payload 14.

The presently disclosed techniques include using one or more floatation devices and/or one or more exchange weights to manage the buoyancy of an ROV and its payload. Specifically, floatation devices (e.g., blocks of syntactic foam) may be attached to the ROV and the payload such that each of the ROV and the payload is within a threshold value of neutrally buoyant. Further, when the ROV deposits or retrieves a payload, the ROV may exchange the payload for an exchange weight having a similar mass as the payload. Using the disclosed techniques, the ROV may retrieve or deposit heavy loads without the buoyancy of the package (i.e., the buoyancy of the ROV and the payload or exchange weight it carries) exceeding a threshold value from neutrally buoyant, such that the thrusters of the ROV can control the depth of the ROV.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

an underwater vehicle configured to transfer a payload between a first location and a second location at a subsea structure, wherein the underwater vehicle comprises a payload support configured to support the payload; and a buoyancy control system comprising an exchange weight system configured to receive one or more exchange weights onto the underwater vehicle from the subsea structure when delivering the payload such that the underwater vehicle carries and moves with the one or more exchange weights after delivering the payload.

2. The system of claim 1, wherein the buoyancy control system comprises a floatation system having one or more floatation devices coupled to the payload.

3. The system of claim 1, comprising the subsea structure having one or more receptacles configured to support the payload, one or more exchange weights, or a combination thereof.

4. The system of claim 3, wherein the subsea structure comprises a subsea installation.

5. The system of claim 3, wherein the subsea structure comprises a subsea hydrocarbon drilling installation.

6. An underwater vehicle, comprising:

a frame defining a first payload receptacle and a first exchange weight receptacle; and docking hardware configured to facilitate docking the underwater vehicle to a subsea structure;

wherein the underwater vehicle is configured to deposit a payload from the first payload receptacle of the underwater vehicle to a second payload receptacle of the subsea structure and retrieve an exchange weight from a second exchange weight receptacle of the subsea structure into the first exchange weight receptacle of the underwater vehicle when the underwater vehicle is docked to the subsea structure.

7. The underwater vehicle of claim 6, wherein the underwater vehicle is configured to retrieve the payload from the second payload receptacle of the subsea structure to the first payload receptacle of the underwater vehicle and deposit the exchange weight from the first exchange weight receptacle of the underwater vehicle into the second exchange weight receptacle of the underwater vehicle subsea structure when the underwater vehicle is docked to the subsea structure.

8. The underwater vehicle of claim 6, comprising payload coupling hardware configured to facilitate transfer of the payload between the underwater vehicle and the subsea structure.

9. The underwater vehicle of claim 6, comprising exchange weight coupling hardware configured to facilitate transfer of the exchange weight between the underwater vehicle and the subsea structure.

10. The underwater vehicle of claim 6, wherein the payload has a first mass and the exchange weight has a second mass, and wherein the first mass and the second mass are within a threshold value of one another.

11. The underwater vehicle of claim 10, wherein the underwater vehicle comprises one or more thrusters, and the one or more thrusters provide sufficient thrust to control a depth of the underwater vehicle when the underwater vehicle is carrying either the payload or the exchange weight.

12. The underwater vehicle of claim 6, comprising a first floatation device coupled to the payload.

13. The underwater vehicle of claim 12, comprising a second floatation device coupled to the frame.

14. The underwater vehicle of claim 13, wherein the first and second floatation devices comprise one or more volumes of syntactic foam.

15. A method, comprising:

docking an underwater vehicle to a subsea structure;

depositing a payload from a first payload receptacle of the underwater vehicle to a second payload receptacle of the subsea structure;

retrieving an exchange weight from a second exchange weight receptacle of the subsea structure into a first exchange weight receptacle of the underwater vehicle; and undocking the underwater vehicle from the subsea structure.

16. The method of claim 15, comprising:

retrieving the payload from the second payload receptacle of the subsea structure to the first payload receptacle of the underwater vehicle; and depositing the exchange weight from the first exchange weight receptacle of the underwater vehicle into the second exchange weight receptacle of the subsea structure.

17. The method of claim 15, wherein the underwater vehicle comprises a first floatation device and the payload comprises a second floatation device.

18. The method of claim 17, comprising selecting the first floatation device based on the mass of the underwater vehicle and selecting the second floatation device based on the mass of the payload.

19. The method of claim 15, comprising determining a mass of the exchange weight based on a mass of the payload.

* * * * *